US007865103B2

(12) United States Patent
Yoshimura et al.

(10) Patent No.: US 7,865,103 B2
(45) Date of Patent: Jan. 4, 2011

(54) IMAGE FORMING APPARATUS AND IMAGE FORMING SYSTEM DISPLAYING TRANSFER SHEET COLOR

(75) Inventors: Kazutoshi Yoshimura, Tokyo (JP); Satoshi Sakata, Tokyo (JP); Kenji Yamamoto, Tokyo (JP); Kazumichi Yamauchi, Tokyo (JP); Hideki Nakamura, Tokyo (JP); Akira Okamoto, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 209 days.

(21) Appl. No.: 11/972,132

(22) Filed: Jan. 10, 2008

(65) Prior Publication Data

US 2009/0052930 A1 Feb. 26, 2009

(30) Foreign Application Priority Data

Aug. 23, 2007 (JP) ..... 2007-216756

(51) Int. Cl.
*G03G 15/00* (2006.01)

(52) U.S. Cl. ..... 399/81; 399/82; 399/389

(58) Field of Classification Search ..... 399/82, 399/81, 389, 388
See application file for complete search history.

(56) References Cited

U.S. PATENT DOCUMENTS

| | | | | |
|---|---|---|---|---|
| 6,290,318 | B1 * | 9/2001 | Yasukawa | |
| 6,421,510 | B2 * | 7/2002 | Nakata et al. | 399/82 |
| 7,619,771 | B2 * | 11/2009 | Jacob et al. | |
| 2002/0051182 | A1 * | 5/2002 | Sommer et al. | |
| 2007/0171440 | A1 * | 7/2007 | Yoshida | |
| 2008/0107433 | A1 * | 5/2008 | Yamamoto et al. | |

FOREIGN PATENT DOCUMENTS

| | | | |
|---|---|---|---|
| JP | 58-117567 A | | 7/1983 |
| JP | 01280773 A | * | 11/1989 |
| JP | 03180866 A | * | 8/1991 |
| JP | 4-362969 A | | 12/1992 |
| JP | 7-187475 A | | 7/1995 |
| JP | 07181756 A | * | 7/1995 |
| JP | 10-42084 A | | 2/1998 |

(Continued)

OTHER PUBLICATIONS

Office Action for Japanese Patent Application No. 2007-216756 dated Aug. 14, 2009 with English translation.

*Primary Examiner*—Susan S Lee
(74) *Attorney, Agent, or Firm*—Cantor Colburn LLP

(57) ABSTRACT

An image forming apparatus for forming a visible image on a transfer sheet according to a job, the image forming apparatus including: a plurality of sheet feed trays adapted to load plural kinds of transfer sheets; an image forming section for forming a visible image according to image data on a transfer sheet; a conveying section for conveying a transfer sheet from each of the plurality of sheet feed trays toward the image forming section; a display section for displaying various items; a color detection section for detecting a transfer sheet color of the transfer sheet being conveyed by the conveying section; and a control section for controlling a conveyance of the transfer sheet and the image formation, wherein the control section displays a transfer sheet color designated by the job and the transfer sheet color detected by the color detection section on the display section.

41 Claims, 9 Drawing Sheets

FOREIGN PATENT DOCUMENTS

| | | | | |
|---|---|---|---|---|
| JP | 11-272022 | A | | 10/1999 |
| JP | 2001313838 | A | * | 11/2001 |
| JP | 2002-193465 | A | | 7/2002 |
| JP | 2003-219173 | A | | 7/2003 |
| JP | 2005-43860 | A | | 2/2005 |
| JP | 2005-283675 | A | | 10/2005 |
| JP | 2006-80858 | A | | 3/2006 |
| JP | 2006139089 | A | * | 6/2006 |

* cited by examiner

IMAGE FORMING APPARATUS AND IMAGE FORMING SYSTEM DISPLAYING TRANSFER SHEET COLOR

RELATED APPLICATION

This application is based on Japanese Patent Application No. 2007-216756 on Aug. 23, 2007 in Japan Patent Office, the entire content of which is hereby incorporated by reference.

FIELD OF THE INVENTION

The present invention relates to an image forming apparatus and an image forming system, for forming images on appropriate transfer sheets when executing image formation in a state where the transfer sheets include color sheets.

DESCRIPTION OF THE RELATED ART

There is an image forming apparatus which has a plurality of sheet feed trays, loads different transfer sheets on the respective sheet feed trays, and switches the sheet feed trays during execution of the image formation. In such an image forming apparatus, color sheets are used as a partition sheet or as a separator for each job.

Such an image forming apparatus holds tray information on which sheet feed tray what color of transfer sheets are loaded, selects transfer sheets according to the tray information and job information, thereby executes image formation.

Further, regarding such an image forming apparatus, in the Japanese Unexamined Patent Application Publications indicated below, various proposals are made on selection and detection of the color of transfer sheets.

According to the method described in Japanese Unexamined Patent Application Publication No. 2002-193465 (Page 1, FIG. 1), each of a plurality of sheet feed trays has a color detection section of color sheets which detects whether there is a sheet feed tray where transfer sheets of the designated color are set or not by job information including color designation of transfer sheets, and the image formation is executed if there is.

Japanese Unexamined Patent Application Publication No. 58-117567 (Page 1, FIG. 1) discloses that a color R, G, and B light emission section (light source) for irradiating light to transfer sheets and a light receiving section for detecting light which is reflected from the transfer sheets by irradiating from the light source are installed, and discloses a technique of detecting the color of transfer sheets through performing operations for received light output and displaying it on the operation display section.

Further, in Japanese Unexamined Patent Application Publication No. 7-187475 (Page 1, FIG. 1) discloses a method of detecting color sheets loaded on a sheet feed tray by the color sensor and sending accurately the color sheets on issuing a color sheet sending instruction even if the sheet feed tray loading the color sheets used as a job separator is mounted at any sheet feed position of the image forming apparatus.

However, in the Japanese unexamined patent application publications aforementioned, the color of the transfer sheet at the uppermost position of each sheet feed tray is detected, thus the color of the transfer sheets loaded on each sheet fed tray is judged, and a problem of judging the color of the transfer sheet arises when there are color sheets of different colors mixed in the sheet feed trays.

Further, in this case, when even one different color transfer sheet is mixed in the sheet feed trays, a copy of whole image forming output material subjected to mixture is handled as spoilage which cannot be shipped and a large waste is caused.

In the image forming apparatus and image forming system used for print on demand, various transfer sheets are used and the colors of transfer sheets are also various. Therefore, as transfer sheet information, not only the sheet kind, sheet size, and weight but also the transfer sheet color are necessary.

Further, not only in image formation on simple monochromatic transfer sheets but also in duplex image formation, different colors may be used on the front and rear, though there is a problem which cannot be coped with by the unexamined patent application publications aforementioned.

Further, when the image forming apparatus is equipped with multistage sheet feed trays, a countermeasure for a setting error of the sheet feed trays by an operator is required.

Further, when detecting the transfer sheet color on the sheet feed trays as described in the unexamined patent application publications aforementioned, it is necessary to arrange a sensor on each sheet feed tray, thus when multistage sheet feed trays are installed, a problem of an increase in cost arises.

And, in the methods of the unexamined patent application publications aforementioned, although an attempt is made to make the designation of the transfer sheet color by the job coincide with the transfer sheet for actual image formation, a method for automatically confirming whether the designation of the transfer sheet color by the job coincides with the transfer sheet color of the actual image forming output material or not is not established, thus a problem arises that the operator must confirm actually the actual image forming output material.

SUMMARY OF THE INVENTION

The present invention was developed to solve the aforementioned problems and is intended to provide an image forming apparatus and an image forming system for executing image formation using transfer sheets of a desired color designated by the job and automatically confirming whether the designation of the transfer sheet color by the job coincides with the transfer sheet color of the actual image forming output material or not.

One aspect of the present invention is an image forming apparatus for forming a visible image on a transfer sheet according to a job, the image forming apparatus comprising: a plurality of sheet feed trays adapted to load plural kinds of transfer sheets; an image forming section for forming a visible image according to image data on a transfer sheet; a conveying section for conveying the transfer sheet from the transfer sheet trays toward the image forming section; a display section for displaying various items; a color detection section for detecting a transfer sheet color of the transfer sheet being conveyed by the conveying section; and a control section for controlling a conveyance of the transfer sheet and an image formation, wherein the control section displays a transfer sheet color designated by the job and the transfer sheet color detected by the color detection section on the display section.

Another aspect of the present invention is an image forming system comprising: a display apparatus for displaying various items according to a control to form image by a control section; and a image forming apparatus for forming a visible image on a transfer sheet according to a job, wherein the image forming apparatus comprises: the control section for controlling to form image; a plurality of sheet feed trays adapted to load plural kinds of transfer sheets; an image forming section for forming a visible image according to image data on a transfer sheet; and a conveying section for conveying the transfer sheet from the transfer sheet trays toward the image forming section; and a color detection section for detecting a transfer sheet color of the transfer sheet when the transfer sheet is conveyed by the conveying section, wherein the control apparatus displays the transfer sheet color designated by the job and the transfer sheet color detected by the color detection section on the display section.

DESCRIPTION OF THE PREFERRED EMBODIMENT

Hereinafter, the preferred embodiment (hereinafter, referred to as the embodiment) for executing the present invention will be explained in detail with reference to the accompanying drawings.

Figure 1:
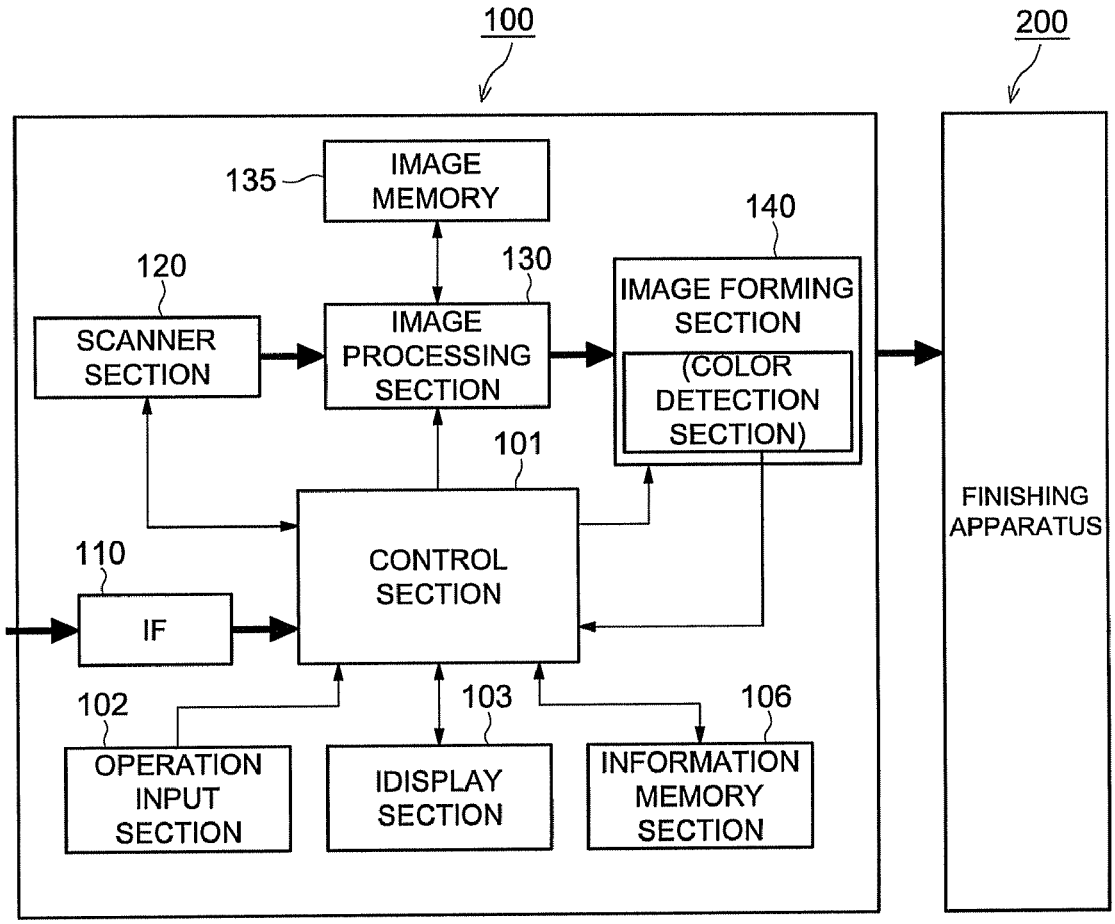
FIG. 1 is a block diagram showing the constitution of the image forming apparatus of the embodiment of the present invention.

FIG. 1 is a block diagram showing the constitution of a concrete example of the copying apparatus as an image forming apparatus 100 of the first embodiment of the present invention.

In FIG. 1, numeral 101 indicates a control section composed of a CPU as a control section for controlling the whole image forming apparatus 100, 102 an operation input section for inputting a preset operation of the image forming apparatus by a user or a key operator, and 103 a display section for displaying the apparatus condition to the user. Here, the operation input section and display section for performing individually the input and display of the operation are shown, though a constitution of an operation display section for performing the two may be used. Numeral 106 indicates an information memory section for holding various information regarding image formation such as tray information and transfer sheet information.

Numeral 110 indicates an interface for receiving image data from an external apparatus, which receives the image data when the image forming apparatus 100 operates as a printer.

Numeral 120 indicates a scanner section for optically scanning and reading image information of a document, thereby generating image data, which is composed of an image reading section for scanning an image of a document and generating image data and an automatic document feeding section (ADF) for automatically feeding the document to the image reading section.

Numeral 130 indicates an image processing section for performing a predetermined image process for the image data read and obtained by the scanner section 120, which has an image memory 135 having a predetermined capacity for holding image data as required.

Numeral 140 indicates a print engine for forming an image (a toner image) according to the image data on a recording sheet and outputting it, including a sheet feed section for feeding desired sheets from the sheet feed tray to the image forming section, a conveying section for conveying the fed recording sheet at a predetermined speed, an image write section for generating a laser beam according to the image data, an image forming section for generating a toner image from a latent image according to the laser beam and transferring it to the recording sheet, and a color detection section for detecting the color of transfer sheets.

Figure 2:
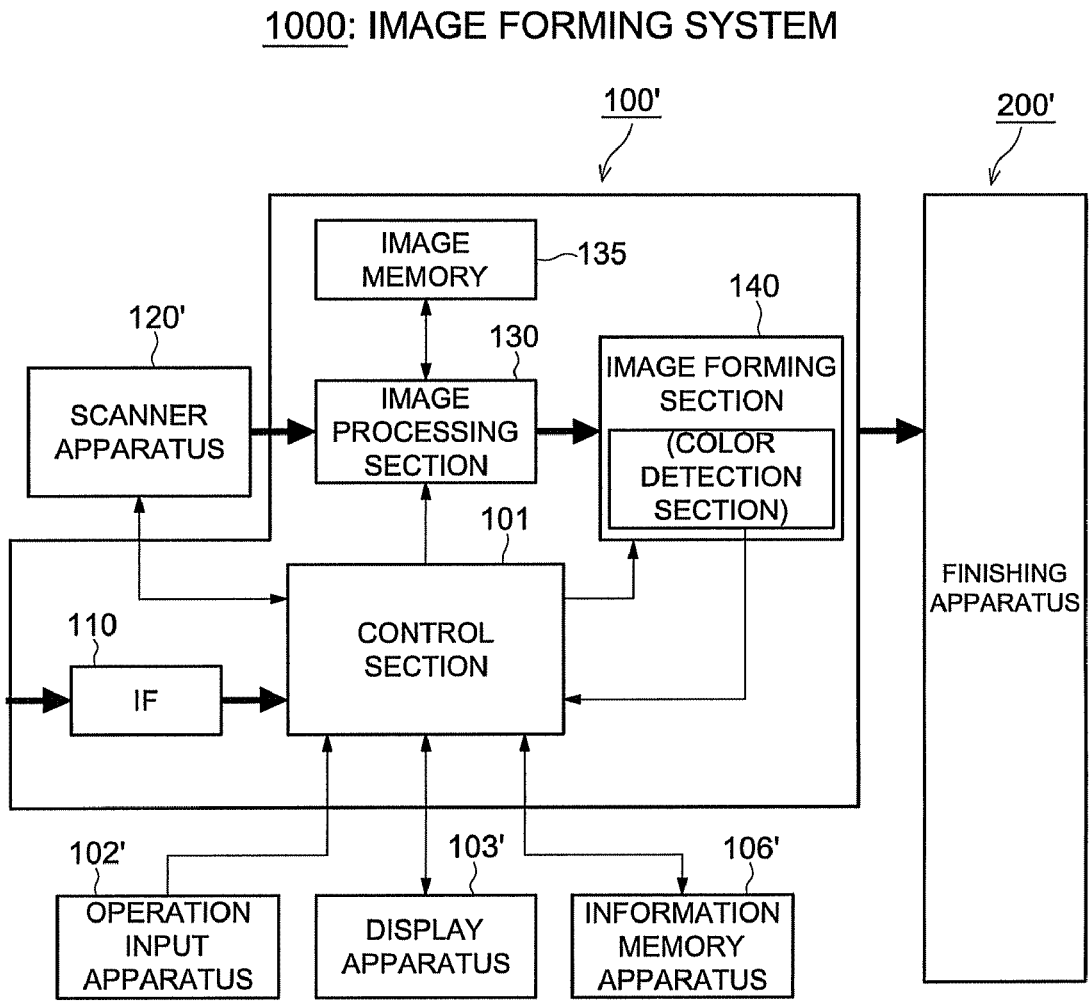
FIG. 2 is a block diagram showing the constitution of the image forming system of the embodiment of the present invention.

FIG. 2 is a block diagram showing the constitution of a concrete example of the print system as an image forming system 1000 of the first embodiment of the present invention using an image forming apparatus 100', an operation input apparatus 102', a display apparatus 103', an information memory apparatus 106', a scanner apparatus 120', and a post-processing apparatus 200'.

In FIG. 2, to the same components as those shown in FIG. 1, the same numerals are assigned and to the similar components as those shown in FIG. 1, "'" is attached to the same numerals. In this case, as a print system, the image forming apparatus 100' for executing image formation and print and the apparatuses for executing operation input and various displays are installed in separate rooms or installed separately from each other in the same room and are connected to each other via various signal lines and a network. Further, the image forming system may have the operation input section 102 and display section 103 as an image forming apparatus 100' or may have the operation input section 102' and display section 103' at separate positions.

Further, the constitution of each component of the image forming system shown in FIG. 2 is the same as that of the image forming apparatus shown in FIG. 1, so that in the embodiment indicated below, the image forming apparatus 100 will be explained as a concrete example.

Figure 3:
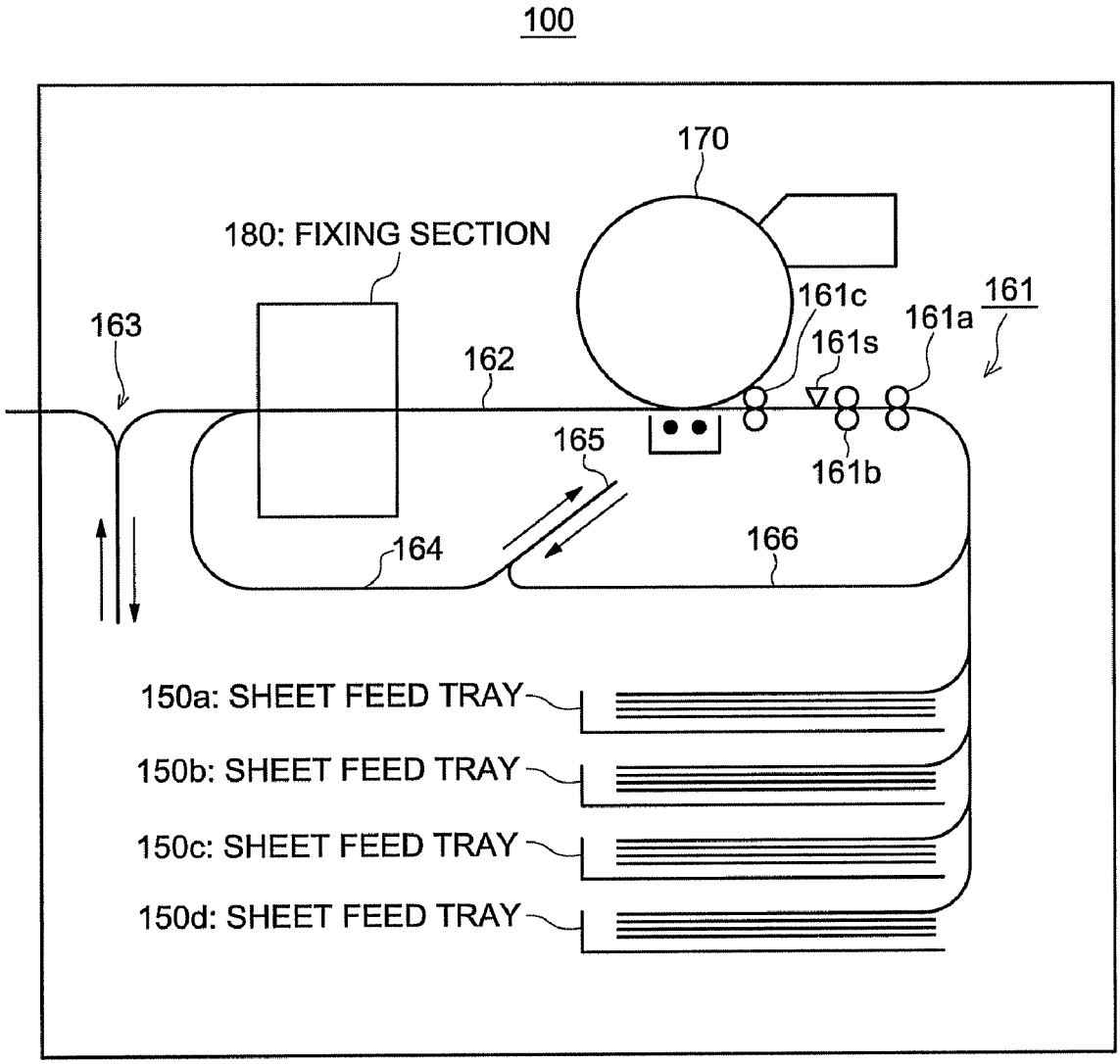
FIG. 3 is a block diagram showing the sectional constitution of the image forming apparatus of the embodiment of the present invention.

Further, FIG. 3 is a block diagram showing the constitution of the essential section regarding the image forming operation of the image forming apparatus 100. Further, here, as an example, an electrophotographic monochromatic image forming apparatus is used as a concrete example. Further, in FIG. 3, the circumference of the part necessary for operation explanation of the characteristic part of this embodiment is shown mainly and the other already-known parts of the image forming apparatus are omitted.

Firstly, the constitution and operation of the image forming apparatus 100 will be explained by referring to FIG. 3. On sheet feed trays 150*a* to 150*d*, transfer sheets are loaded as a subject to be conveyed and are discharged into a conveying section by sheet feed rollers (not drawn).

The discharged transfer sheet is conveyed at a predetermined fixed speed suited to image formation, and the timing thereof is adjusted by loop rollers 161*a*, registration rollers 161*b*, and transfer-preceding rollers 161*c*, and a toner image is transferred thereto from an image carrier 170 such as a photosensitive drum or a photosensitive belt.

Further, in this case, the displacement of transfer sheet is detected by a displacement detection sensor 161*s* arranged in the perpendicular direction to the sheet of paper of FIG. 3 which is the longitudinal direction. The displacement detection sensor 161*s* is composed of a color line sensor and composes the color detection section 161*s* of this embodiment. And, the color detection section 161*s* detects the transfer sheet color on the image forming surface of the transfer sheet being conveyed by a conveying section. Namely, even in double-side image formation, it detects the transfer sheet colors on the first image forming surface and second image forming surface. The displacement detection result and transfer sheet color detection result are transferred to the control section 101 shown in FIG. 1.

The transfer sheet with the toner image transferred to is conveyed on a conveying path 162 and the toner image is fixed on the transfer sheet by heating and pressurization at a fixing section 180. The transfer sheet is subject, when necessary, to switch-back system reverse conveyance at a reverse conveying section 163, and the front and rear are reversed, and the transfer sheet is ejected with the image forming surface directed downward. Further, at the reverse conveying section 163, to prevent the reversed transfer sheet and the succeeding transfer sheet from a collision, the switch-back is executed at a higher speed than a predetermined conveying speed.

Further, when executing the double-side image formation, the transfer sheet fixed at the fixing section 180 is led to a circulating conveying section 164, is reversed the front and rear by the switch-back system reverse conveyance at a circulating reverse conveying section 165, and furthermore is led from a circulating conveying section 166 to the conveying section 161, thus the image formation is executed on the rear. Further, also at the circulating reverse conveying section 165, to prevent the reversed transfer sheet and the succeeding transfer sheet from a collision, the switch-back is executed at a higher speed than the predetermined conveying speed.

Further, for transfer sheets outputted normally and abnormal transfer sheets of a color difference, as an image forming apparatus 100, the known distribution section may be installed or as a post-processing apparatus 200, distribution may be executed as a part of the post processing.

The Embodiment of the Present Invention

Hereinafter, the operation of the image forming apparatus of this embodiment will be explained by referring to the flow charts shown in FIGS. 4 and 7.

Firstly, by referring to the flow chart shown in FIG. 4, registration of a transfer sheet prior to image formation will be explained.

Figure 4:
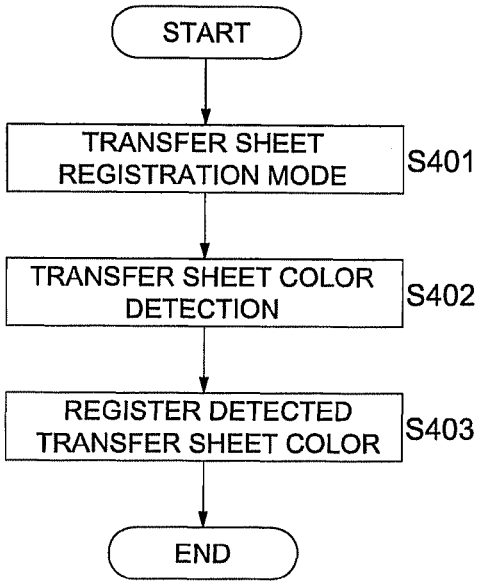
FIG. 4 is a flow chart showing the operation (registering of transfer sheets) of the image forming apparatus of the embodiment of the present invention.

Here, an operator operates the operation input section 102 of the image forming apparatus 100 and changes the image forming apparatus 100 from the ordinary image forming mode to the transfer sheet registration mode (Step S401 shown in FIG. 4). The transfer sheet registration mode is a mode for registering the kind, size, weight, and color of transfer sheets loaded on each sheet feed tray as tray information.

In the transfer sheet registration mode, the control section 101 circulates and conveys the transfer sheets loaded on each sheet feed tray without executing image formation in the same procedure as double-side image formation. At this time, at the color detection section 161*s*, the color detection results for both sides of each transfer sheet are obtained (Step S402 shown in FIG. 4). Further, the color detection of the transfer sheets can be executed by the scanner section 120 instead of the color detection section 161*s*. And, the transfer sheet color detection results are transferred to the control section 101.

Figure 5:
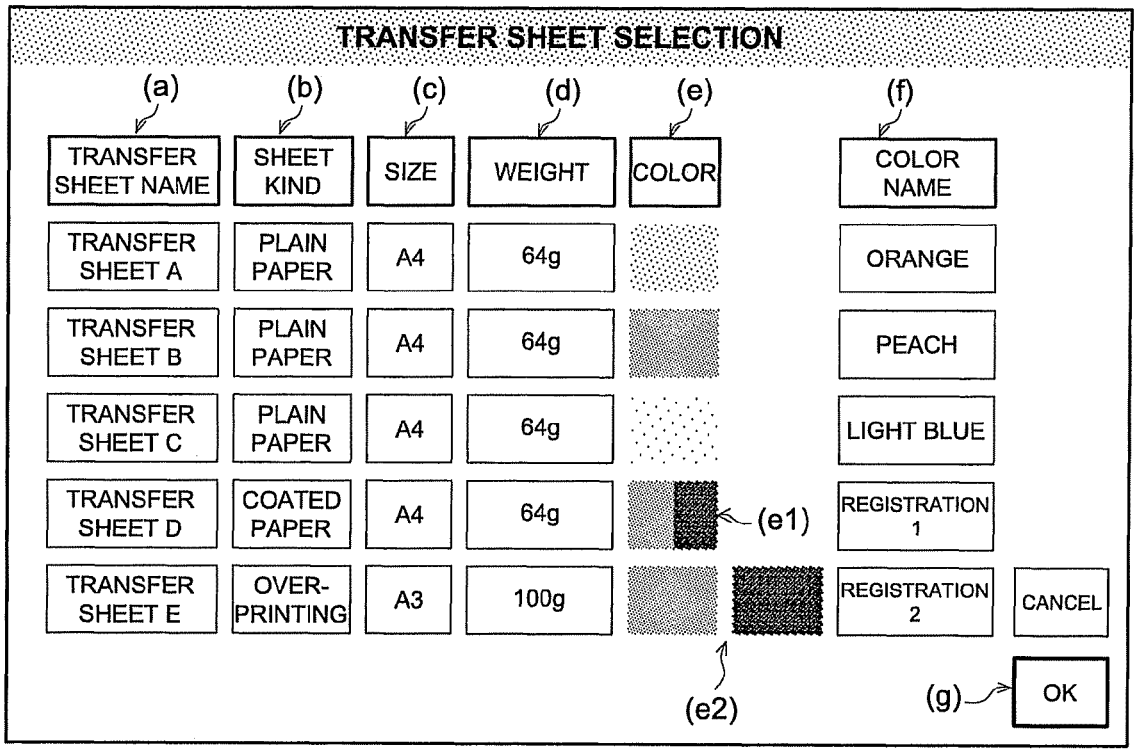
FIG. 5 is an illustration showing a display example on the display section of the image forming apparatus of the embodiment of the present invention.

The control section 101 receiving the color detection results displays the transfer sheet selection screen as shown in FIG. 5 on the display section 103.

On the transfer sheet selection screen shown in FIG. 5, the items such as the transfer sheet name (FIG. 5(*a*)), sheet kind (FIG. 5(*b*)), size (FIG. 5(*c*)), weight (FIG. 5(*d*)), color (FIG. 5(*e*)), and color name (FIG. 5(*f*)) are displayed and each item is displayed for each transfer sheet.

Here, regarding the size (FIG. 5(*c*)) and color (FIG. 5(*e*)), from the detection results, the control section 101 judges and displays.

When the display section 103 permits color display, it executes color display for the color (FIG. 5(*e*)) of each transfer sheet. Further, when one side of each transfer sheet is composed of a plurality of colors, the plurality of colors are displayed clearly (FIG. 5(*e*1)). Further, when both sides of each transfer sheet are different in color, the colors of both sides are displayed clearly (FIG. 5(*e*2)).

Further, regarding the transfer sheet name (FIG. 5(*a*)), sheet kind (FIG. 5(*b*)), weight (FIG. 5(*d*), and color name (FIG. 5(*f*)), the operator inputs them from the operation input section 102.

Here, in this embodiment, the color names are displayed as shown in FIG. 5(*f*). Further, the color name may be selected from the selection candidates (not shown) and in the case of two colors on one side or different colors on both sides, a new color name may be inputted.

Further, without using the transfer sheet color detected by the color detection section 161*s*, the operator may select the transfer sheet color (FIG. 5(*e*)) from the color pallet selection candidates (not shown). When using transfer sheets which are similar to chroma and different in brightness, the operator can correct them in this way. When the setting of each item for the transfer sheets loaded on each sheet feed tray is completed in this way and the operator clicks the icon of "OK" (FIG. 5(*g*)), the control section 101 registers the transfer sheets and preserves the items aforementioned in the information memory section 106 as transfer sheet information or tray information (Step S403 shown in FIG. 4).

Next, by referring to the flow chart shown in FIG. 7, the execution of image formation will be explained.

Figure 7:
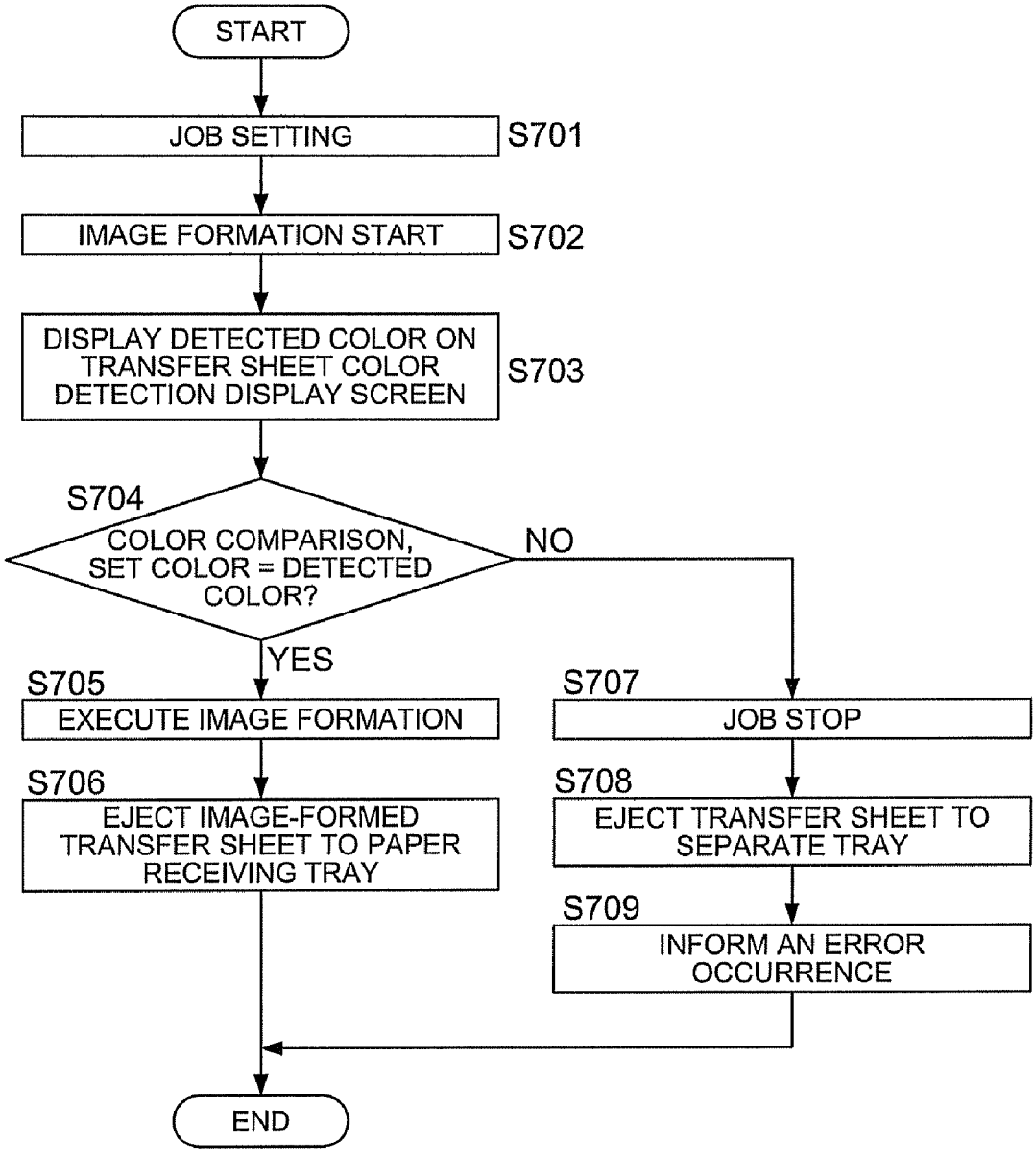
FIG. 7 is a flow chart showing the operation (execution of the job) of the image forming apparatus of the embodiment of the present invention.

Here, firstly, the operator sets the job from the operation input section 102 (Step 5701 shown in FIG. 7).

Figure 6:
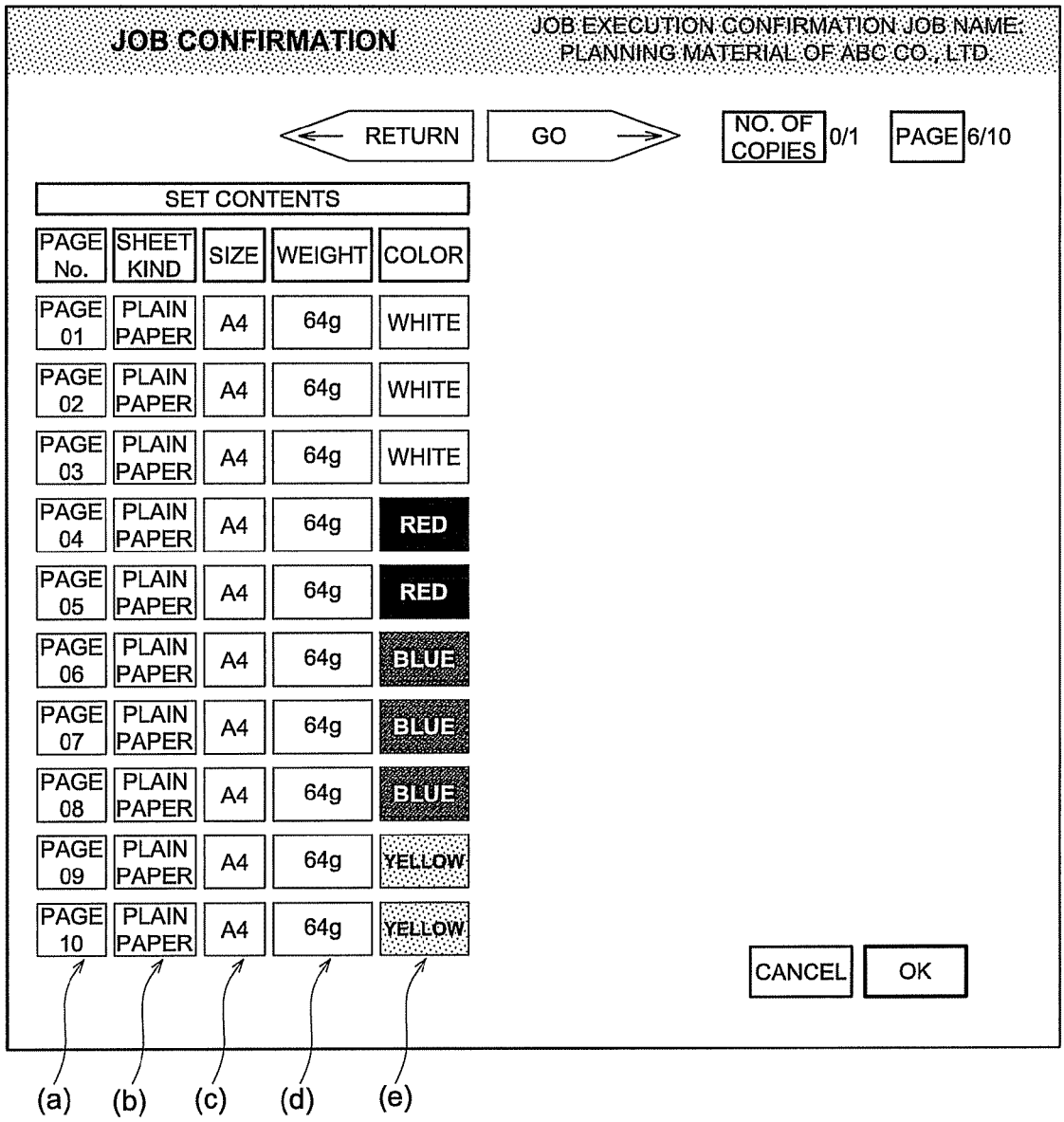
FIG. 6 is another illustration showing a display example on the display section of the image forming apparatus of the embodiment of the present invention.

Here, the control section 101 displays the job confirmation screen as shown in FIG. 6 on the display section 103. On the job confirmation screen, regarding a plurality of pages, for each page No. (FIG. 6(*a*)), the sheet kind of each transfer sheet to be used (FIG. 6(*b*)), size (FIG. 6(*c*)), weight (FIG. 6(*d*)), and transfer sheet color (FIG. 6(*e*)) are listed.

Figure 8:
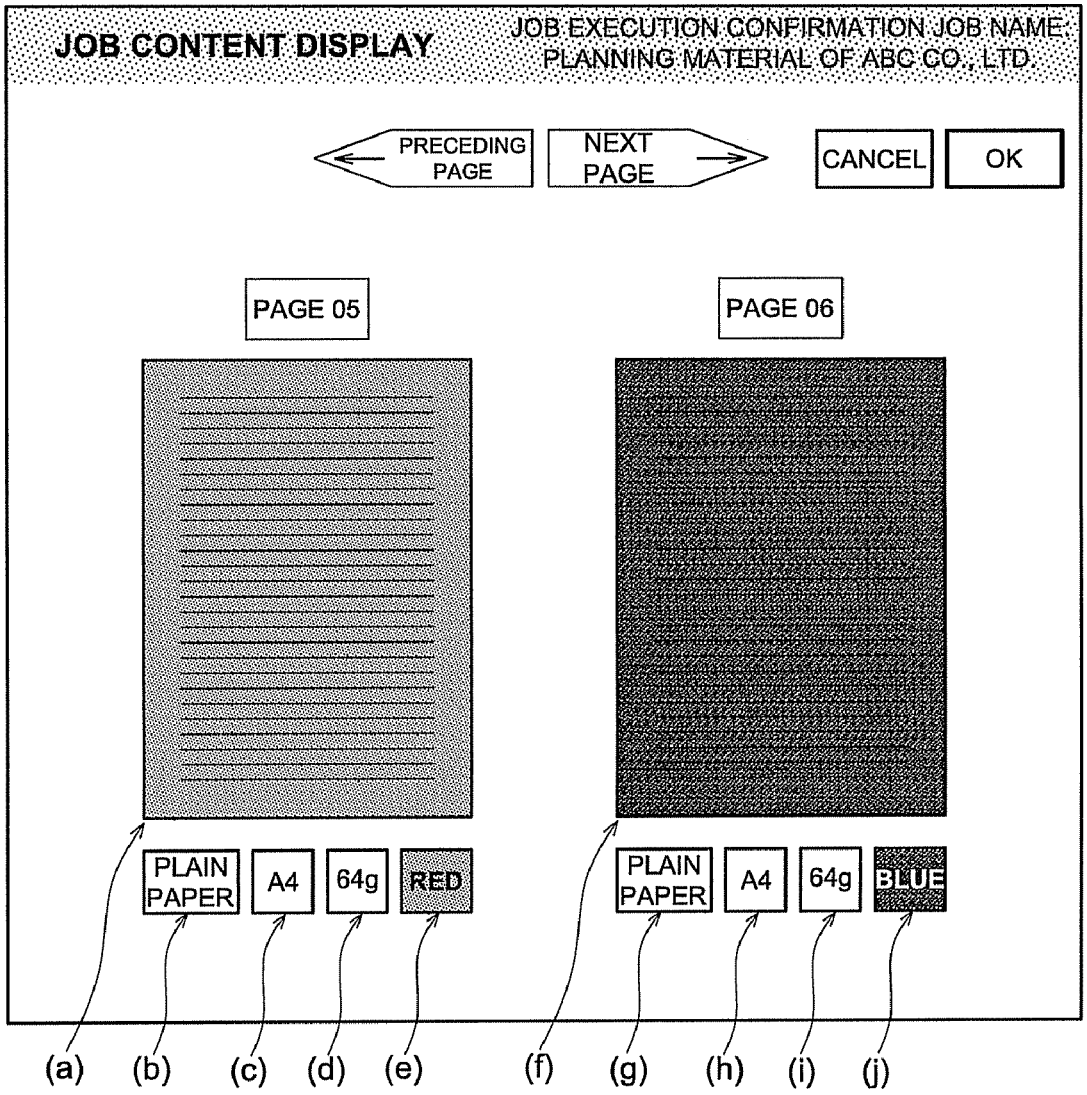
FIG. 8 is still another illustration showing a display example on the display section of the image forming apparatus of the embodiment of the present invention.

Further, the control section 101, in the detailed display mode, displays the image forming-image display screen for each page as shown in FIG. 8 on the display section 103.

In the detailed display mode screen shown in FIG. 8, for example, every two pages, the image forming-image display screen for each page (FIGS. 8(*a*) and (*f*)) and the sheet kind of the transfer sheet to be used on each page (FIGS. 8(*b*) and (*g*)), transfer sheet size (FIGS. 8(*c*) and (*h*)), transfer sheet weight (FIGS. 8(*d*) and (*i*)) and, transfer sheet color (FIGS. 8(*e*) and (*j*)) are displayed.

By referring to this display, the operator confirms the transfer sheets to be used for the job, if necessary, clicks the corresponding icon, and sets such as selection of transfer sheets of a different sheet kind, size, weight, and color (Step S701 shown in FIG. 7).

When the aforementioned job setting by the operator is completed and the Start button is pressed from the operation input section 102, the control section 101 gives an instruction to the image forming section 140 to start image formation (Step S702 shown in FIG. 7).

During execution of the image formation, the detection results of the color of the transfer sheets detected by the color detection section 161*s* are transferred to the control section 101. As shown in FIG. 3, when using the detection results of the color detection section 161*s* positioned on the upstream side of the image carrier 170 in the conveying direction, immediately before execution of image formation, the color of each transfer sheet is ascertained.

Figure 9:
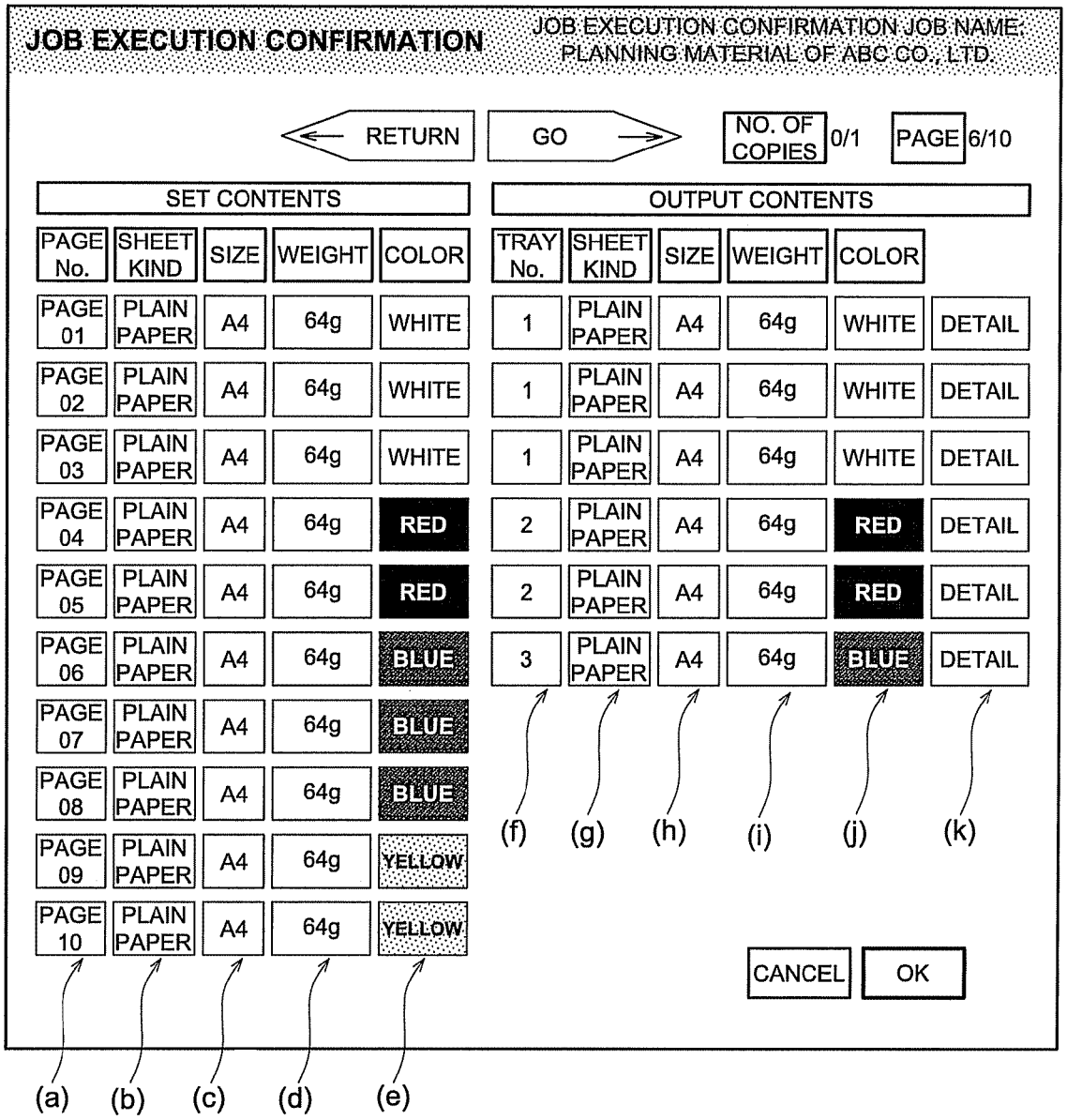
FIG. 9 is a further illustration showing a display example on the display section of the image forming apparatus of the embodiment of the present invention.

Here, the control section 101 displays the job execution confirmation screen as shown in FIG. 9 on the display section 103 and displays the transfer sheet color detection results on the screen (Step S703 shown in FIG. 7).

In this case, the control section 101, as a job execution confirmation display screen, displays the set job contents and the image formation of the job executed actually in correspondence with them, as shown in FIG. 9, in the comparison state of the left with the right on the screen.

Here, the control section 101 displays the job execution confirmation screen as shown in FIG. 9 on the display 103. On the set job content display screen (FIG. 9), in one half of the screen, regarding a plurality of pages, for each page No. (FIG. 9(*a*)), the sheet kind of each transfer sheet to be used (FIG. 9(*b*)), size (FIG. 9(*c*)), weight (FIG. 9(*d*)), and transfer sheet color (FIG. 9(*e*)) are listed and for the job executed actually, in the other half of the screen, regarding a plurality of pages, the tray (FIG. 9(*f*)) to which each transfer sheet is outputted, sheet kind of each transfer sheet used (FIG. 9(*g*)), size (FIG. 9(*h*)), weight (FIG. 9(*i*)), and transfer sheet color (FIG. 9(*j*)) are listed. Further, when the detail button (FIG. 9(*k*)) for each page is clicked, more detailed information is displayed.

As a result, the image formation is executed using transfer sheets of a desired color designated by the job and whether the designation of the transfer sheet color by the job coincides with the transfer sheet color of the actual image forming output material or not can be confirmed easily by the operator. Further, in this case, the color display of the color itself and also the color name display are executed, so that similar colors different in density and coloring can be distinguished.

Further, on the job execution confirmation screen of the display section 103 instructed by the control section 101, the information on the transfer sheet in execution of image formation at present and the preceding and subsequent transfer sheets thereof is displayed, though when the operator clicks the icon of "Return" or "Go" on the screen, he can confirm the preceding set contents and output contents or pre-confirm the preceding set contents.

Further, the control section 101 compares the color of transfer sheets designated by the job with the color of transfer sheets conveyed actually (Step S704 shown in FIG. 7), when the transfer sheet colors coincide with each other (YES at Step S704 shown in FIG. 7), controls so as to execute straightly the image formation (Step S705 shown in FIG. 7), and ejects the image-formed transfer sheets to a predetermined paper receiving tray (Step S706 shown in FIG. 7).

On the other hand, when the transfer sheet colors do not coincide with each other (NO at Step S704 shown in FIG. 7), the control section 101 controls so as to stop the execution of image formation (Step S707 shown in FIG. 7), ejects transfer sheets of a different color from the designated color to another predetermined paper receiving tray (Step S708 shown in FIG. 7), and displays the purport of an occurrence of an error of conveyance of transfer sheets of a color different from the designated color on the display section 103 (Step S709 shown in FIG. 7). In this case, the control section 101, on the display section 103, may display the items of the transfer sheets judged as an error in the blinking state or may use blinking display together with information by a warning sound.

As mentioned above, the transfer sheet color designated by the job is compared with the transfer sheet color detected by the color detection section and when inconsistency of colors occurs, the execution of image formation is stopped, so that an image forming output material using a transfer sheet of a color other than a color designated by the job will not be outputted. Further, by doing this, the overall transfer sheets which are not transfer sheets of a different color and are outputted normally until then can be prevented from coming to naught. Namely, from the place where the transfer sheet of a different color is conveyed, the image formation is restarted using normal transfer sheets, thus the waste of transfer sheets can be minimized.

Further, in this embodiment, in the case of double-side image formation, the respective colors of the front and rear of a transfer sheet which are designated by the job and the respective colors of the front and rear of a transfer sheet which are detected by the color detection section are displayed on the display section 103. As a result, it is possible to execute image formation on both sides of a transfer sheet of a desired color designated by the job and confirm whether the designated colors on both sides of the transfer sheet by the job coincides with the colors on both sides of a transfer sheet of an actual image forming output material or not.

Further, in the aforementioned embodiment, it is not needed to arrange a sensor on each sheet feed tray of multi-stage sheet feed trays and the cost of the image forming apparatus can be reduced.

Further, in the embodiment aforementioned, the displacement detection section for detecting conveyance of transfer sheets in the displacement state is used also as a color detection section 161*s*, so that there is no need to newly install an exclusive detection section and the conventionally existing image forming apparatus can be used as it is.

Further, the image forming apparatus, when registering transfer sheets, regarding the color of the transfer sheets, has a function for registering the color name, so that by giving an appropriate name beforehand, similar colors different in density and coloring which are hardly distinguished by the color display of the display section 103 can be distinguished.

Further, in the embodiment aforementioned, when registering transfer sheets, regarding the color of the transfer sheets loaded on each sheet feed tray, the detection results of the color detection section 161*s* are used and the input from the operation input section 102 are used, thus the transfer sheets are registered. By doing this, the transfer sheet color can be set meticulously and it is possible to select appropriately transfer sheets loaded on each sheet feed tray and form images in correspondence to the job.

The concrete example that the color detecting section 161*s* is arranged on the upstream side of the image carrier 170 and executing image formation is stopped before executing image formation is shown in the embodiment aforementioned. Further, even if the color detecting section 161*s* is arranged on the downstream side of the image carrier, immediately after execution of image formation before the concerned transfer sheet of a different color is ejected, the operation of the image forming apparatus can be stopped or the concerned transfer sheet of a different color can be ejected to a separate predetermined paper receiving tray, thus an image forming output material using a transfer sheet of a color other than a color designated by the job will not be outputted. By doing this, the overall transfer sheets at the same section which are not transfer sheets of a different color and are outputted normally until then can be prevented from coming to naught. Namely, from the place where the transfer sheet of a different color is conveyed, the image formation is restarted using normal transfer sheets, thus the waste of transfer sheets can be minimized to only one sheet.

Further, in the embodiment aforementioned, the concrete example that the color detecting section 161*s* is arranged on the upstream side of the image carrier 170 and is arranged between the registration rollers 161*b* and the transfer-preceding rollers 161*c* is indicated, though the present invention is not limited to this position. The position may be set between the position where the path of the transfer sheets from each sheet feed tray and the path the transfer sheets circulating for double-side image formation meet and the position before the distribution section for distributing ejection sheets to each paper receiving tray.

Figure 10:
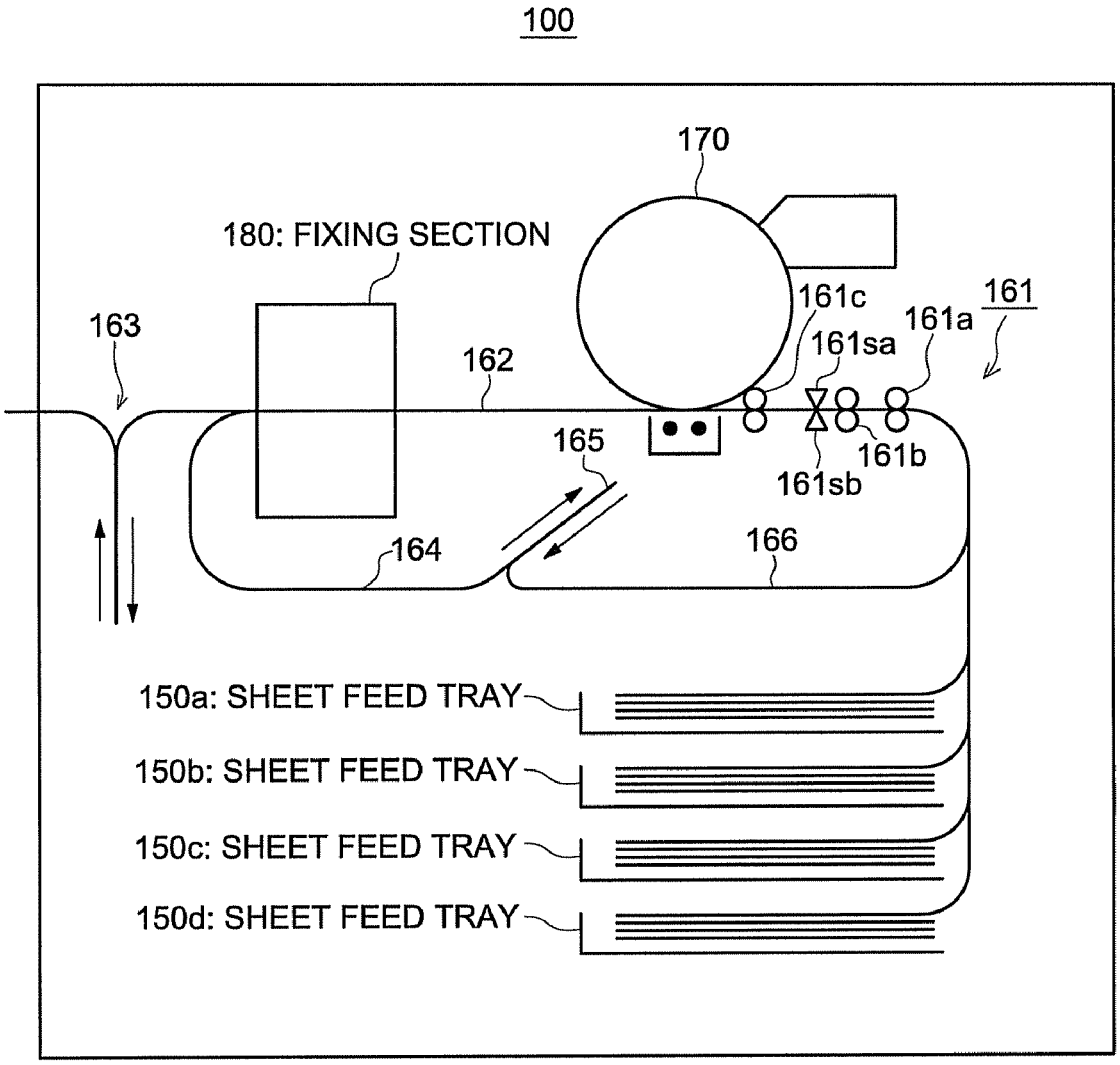
FIG. 10 is a block diagram showing the constitution of the image forming apparatus of the embodiment of the present invention.

Further, to detect the case that both sides are different in color, for the rears of transfer sheets which are circulated and re-fed for front and double-side image formation of transfer sheets fed from each sheet feed tray, the color may be sequentially detected by the color detection section 161*s*, though as shown in FIG. 10, using a color detection section 161*sa* for detecting the color of the front of each transfer sheet and a color detection section 161*sb* for detecting the color of the rear of each transfer sheet, the colors of both sides of each transfer sheet may be detected at the same time.

Further, the color detection sections 161*sa* and 161*sb* may be separate sensors, though they may be integrally formed in a shape that the intermediate parts thereof hold transfer sheets and permit them to pass through.

The colors of both sides of each transfer sheet are detected simultaneously as mentioned above, thus when the color of the front coincides with the set color, while the color of the rear is different from the set color, before executing the image formation of the front, it is possible to find a color difference, thereby stop the image forming operation.

Further, in the embodiment aforementioned, the color is not limited to the ordinary colors in the visible ray zone and may include fluorescence generated by irradiation of specific excitation light and may be detected and controlled. Further, in the embodiment aforementioned, as a color difference, the color may be detected and controlled so as to include existence of gloss.

What is claimed is:

1. An image forming apparatus for forming a visible image on a transfer sheet according to a job, the image forming apparatus comprising:

a plurality of sheet feed trays on which plural kinds of transfer sheets are loaded;

an image forming section to form a visible image according to image data on a transfer sheet;

a conveying section to convey a transfer sheet from each of the plurality of sheet feed trays toward the image forming section;

a display section to display various items;

a color detection section to detect a transfer sheet color of the transfer sheet being conveyed by the conveying section; and a control section for controlling a conveyance of the transfer sheet and the image formation, wherein the control section displays a transfer sheet color designated by the job and the transfer sheet color detected by the color detection section on the display section;

wherein the control section compares the transfer sheet color designated by the job and the transfer sheet color detected by the color detection section and displays a comparison result on the display section.

2. The image forming apparatus according to claim 1, wherein the control section displays a color name of the transfer sheet color designated by the job and a color name of the transfer sheet color detected by the color detection section on the display section.

3. The image forming apparatus according to claim 1, wherein the control section controls so as to stop an execution of image formation when the transfer sheet color detected by the color detection section does not coincide with the transfer sheet color designated by the job.

4. The image forming apparatus according to claim 1, wherein the control section has a function for registering a color name for the transfer sheet color detected by the color detection section.

5. The image forming apparatus according to claim 1, wherein the control section registers the transfer sheet color regarding the transfer sheet color of the transfer sheet loaded on each sheet feed tray according to a detection result of the color detection section.

6. The image forming apparatus according to claim 1, wherein the control section registers the transfer sheet color regarding the transfer sheet color of the transfer sheet loaded on each sheet feed tray according to an input from an operation input section.

7. The image forming apparatus according to claim 1, wherein plural kinds of transfer sheets are loaded on at least one sheet feed tray.

8. The image forming apparatus according to claim 1, wherein the control section:

registers, as a tray information, a kind, a size, a weight, and a transfer sheet color of transfer sheets loaded on each sheet feed tray;

designates, as a job setting, a kind, a size, a weight, and a transfer sheet color of each sheet to be used for forming image thereon;

when forming image, selects the transfer sheets loaded on each sheet feed tray responding to the job based on the tray information and controlling the conveying section to convey the sheets; and displays, on the display section, the kind, the size, the weight, and the transfer sheet color designated by the job, the transfer sheet color detected by the color detection section, and the kind, the size, and the weight registered to the tray of the transfer sheets conveyed by executing the job.

9. An image forming apparatus for forming a visible image on a transfer sheet according to a job the image forming apparatus comprising:

a plurality of sheet feed trays on which plural kinds of transfer sheets are loaded;

an image forming section to form a visible image according to image data on a transfer sheet a conveying section to convey a transfer sheet from each of the plurality of sheet feed trays toward the image forming section;

a display section to display various items;

a color detection section to detect a transfer sheet color of the transfer sheet being conveyed by the conveying section; and a control section for controlling a conveyance of the transfer sheet and the image formation, wherein the control section displays a transfer sheet color designated by the job and the transfer sheet color detected by the color detection section on the display section;

wherein the display section permits color display and the control section executes a display of colors themselves and the color names for the transfer sheet color designated by the job and the transfer sheet color detected by the color detection section on the display section.

10. The image forming apparatus according to claim 9, wherein the control section displays the color name of the transfer sheet color designated by the job and a color name of the transfer sheet color detected by the color detection section on the display section.

11. The image forming apparatus according to claim 9, wherein the control section has a function for registering the color name for the transfer sheet color detected by the color detection section.

12. The image forming apparatus according to claim 9, wherein the control section registers the transfer sheet color regarding the transfer sheet color of the transfer sheet loaded on each sheet feed tray according to a detection result of the color detection section.

13. The image forming apparatus according to claim 9, wherein the control section registers the transfer sheet color regarding the transfer sheet color of the transfer sheet loaded on each sheet feed tray according to an input from an operation input section.

14. The image forming apparatus according to claim 9, wherein plural kinds of transfer sheets are loaded on at least one sheet feed tray.

15. The image forming apparatus according to claim 9, wherein the control section:

registers, as a tray information, a kind, a size, a weight, and a transfer sheet color of transfer sheets loaded on each sheet feed tray;

designates, as a job setting, a kind, a size, a weight, and a transfer sheet color of each sheet to be used for forming image thereon;

when forming image, selects the transfer sheets loaded on each sheet feed tray responding to the job based on the tray information and controlling the conveying section to convey the sheets; and displays, on the display section, the kind, the size, the weight, and the transfer sheet color designated by the job, the transfer sheet color detected by the color detection section, and the kind, the size, and the weight registered to the tray of the transfer sheets conveyed by executing the job.

16. An image forming apparatus for forming a visible image on a transfer sheet according to a job, the image forming apparatus comprising:

a plurality of sheet feed trays on which plural kinds of transfer sheets are loaded;

an image forming section to form a visible image according to image data on a transfer sheet;

a conveying section to convey a transfer sheet from each of the plurality of sheet feed trays toward the image forming section;

a display section to display various items;

a color detection section to detect a transfer sheet color of the transfer sheet being conveyed by the conveying section; and a control section for controlling a conveyance of the transfer sheet and the image formation, wherein the control section displays a transfer sheet color designated by the job and the transfer sheet color detected by the color detection section on the display section;

wherein the control section executes displaying respective colors of front and rear of the transfer sheet designated by the job and the respective colors of the front and rear of the transfer sheet detected by the color detection section on the display section.

17. The image forming apparatus according to claim 16, wherein the control section displays a color name of the transfer sheet color designated by the job and a color name of the transfer sheet color detected by the color detection section on the display section.

18. The image forming apparatus according to claim 16, wherein the control section has a function for registering the color name for the transfer sheet color detected by the color detection section.

19. The image forming apparatus according to claim 16, wherein the control section registers the transfer sheet color regarding the transfer sheet color of the transfer sheet loaded on each sheet feed tray according to a detection result of the color detection section.

20. The image forming apparatus according to claim 16, wherein the control section registers the transfer sheet color regarding the transfer sheet color of the transfer sheet loaded on each sheet feed tray according to an input from an operation input section.

21. The image forming apparatus according to claim 16, wherein plural kinds of transfer sheets are loaded on at least one sheet feed tray.

22. The image forming apparatus according to claim 16, wherein the control section:

registers, as a tray information, a kind, a size, a weight, and a transfer sheet color of transfer sheets loaded on each sheet feed tray;

designates, as a job setting, a kind, a size, a weight, and a transfer sheet color of each sheet to be used for forming image thereon;

when forming image, selects the transfer sheets loaded on each sheet feed tray responding to the job based on the tray information and controlling the conveying section to convey the sheets; and displays, on the display section, the kind, the size, the weight, and the transfer sheet color designated by the job, the transfer sheet color detected by the color detection section, and the kind, the size, and the weight registered to the tray of the transfer sheets conveyed by executing the job.

23. An image forming system comprising:

a display apparatus for displaying various items according to a control to form image by a control section; and an image forming apparatus for forming a visible image on a transfer sheet according to a job, wherein the image forming apparatus comprises:

the control section to control to form image;

a plurality of sheet feed trays on which plural kinds of transfer sheets are loaded;

an image forming section to form a visible image according to image data on a transfer sheet; and a conveying section to convey the transfer sheet from the sheet trays toward the image forming section; and a color detection section to detect a transfer sheet color of the transfer sheet when the transfer sheet is conveyed by the conveying section, wherein the control section displays the transfer sheet color designated by the job and the transfer sheet color detected by the color detection section on the display apparatus; and wherein the control section compares the transfer sheet color designated by the job and the transfer sheet color detected by the color detection section and displays a comparison result on the display apparatus.

24. The image forming system according to claim 23, wherein the control section displays a color name of the transfer sheet color designated by the job and a color name of the transfer sheet color detected by the color detection section on the display apparatus.

25. The image forming system according to claim 23, wherein the control section controls so as to stop an execution of image formation when the transfer sheet color detected by the color detection section does not coincide with the transfer sheet color designated by the job.

26. The image forming system according to claim 23, wherein the control section has a function for registering a color name for the transfer sheet color detected by the color detection section.

27. The image forming system according to claim 23, wherein the control section registers the transfer sheet color regarding the color of the transfer sheet loaded on each sheet feed tray according to a detection result of the color detection section.

28. The image forming system according to claim 23, wherein the control section registers the transfer sheet color regarding the color of the transfer sheet loaded on each sheet feed tray according to an input from an operation input section.

29. The image forming system according to claim 23, wherein the control section:

registers, as a tray information, a kind, a size, a weight, and a transfer sheet color of transfer sheets loaded on each sheet feed tray;

designates, as a job setting, a kind, a size, a weight, and a transfer sheet color of each sheet to be used for forming image thereon;

when forming image, selects the transfer sheets loaded on each sheet feed tray responding to the job based on the tray information and controlling the conveying section to convey the sheets; and displays, on the display apparatus, the kind, the size, the weight, and the transfer sheet color designated by the job, the transfer sheet color detected by the color detection section, and the kind, the size, and the weight registered to the tray of the transfer sheets conveyed by executing the job.

30. An image forming system comprising:

a display apparatus for displaying various items according to a control to form image by a control section; and an image forming apparatus for forming a visible image on a transfer sheet according to a job, wherein the image forming apparatus comprises:

the control section to control to form image;

a plurality of sheet feed trays on which plural kinds of transfer sheets are loaded;

an image forming section to form a visible image according to image data on a transfer sheet; and a conveying section to convey the transfer sheet from the sheet trays toward the image forming section; and a color detection section to detect a transfer sheet color of the transfer sheet when the transfer sheet is conveyed by the conveying section, wherein the control section displays the transfer sheet color designated by the job and the transfer sheet color detected by the color detection section on the display apparatus; and wherein the display apparatus permits color display and the control section executes a display of colors themselves and the color names for the transfer sheet color designated by the job and the transfer sheet color detected by the color detection section on the display apparatus.

31. The image forming system according to claim 30, wherein the control section displays the color name of the transfer sheet color designated by the job and a color name of the transfer sheet color detected by the color detection section on the display apparatus.

32. The image forming system according to claim 30, wherein the control section has a function for registering a color name for the transfer sheet color detected by the color detection section.

33. The image forming system according to claim 30, wherein the control section registers the transfer sheet color regarding the color of the transfer sheet loaded on each sheet feed tray according to a detection result of the color detection section.

34. The image forming system according to claim 30, wherein the control section registers the transfer sheet color regarding the color of the transfer sheet loaded on each sheet feed tray according to an input from an operation input section.

35. The image forming system according to claim 30, wherein the control section:

registers, as a tray information, a kind, a size, a weight, and a transfer sheet color of transfer sheets loaded on each sheet feed tray;

designates, as a job setting, a kind, a size, a weight, and a transfer sheet color of each sheet to be used for forming image thereon;

when forming image, selects the transfer sheets loaded on each sheet feed tray responding to the job based on the tray information and controlling the conveying section to convey the sheets; and displays, on the display apparatus, the kind, the size, the weight, and the transfer sheet color designated by the job, the transfer sheet color detected by the color detection section, and the kind, the size, and the weight registered to the tray of the transfer sheets conveyed by executing the job.

36. An image forming system comprising:

a display apparatus for displaying various items according to a control to form image by a control section; and an image forming apparatus for forming a visible image on a transfer sheet according to a job, wherein the image forming apparatus comprises:

the control section to control to form image;

a plurality of sheet feed trays on which plural kinds of transfer sheets are loaded;

an image forming section to form a visible image according to image data on a transfer sheet; and a conveying section to convey the transfer sheet from the sheet trays toward the image forming section; and a color detection section to detect a transfer sheet color of the transfer sheet when the transfer sheet is conveyed by the conveying section, wherein the control section displays the transfer sheet color designated by the job and the transfer sheet color detected by the color detection section on the display apparatus; and wherein the control section executes displaying respective colors of front and rear of the transfer sheet designated by the job and the respective colors of the front and rear of the transfer sheet detected by the color detection section on the display apparatus.

37. The image forming system according to claim 36, wherein the control section displays a color name of the transfer sheet color designated by the job and a color name of the transfer sheet color detected by the color detection section on the display apparatus.

38. The image forming system according to claim 36, wherein the control section has a function for registering a color name for the transfer sheet color detected by the color detection section.

39. The image forming system according to claim 36, wherein the control section registers the transfer sheet color regarding the color of the transfer sheet loaded on each sheet feed tray according to a detection result of the color detection section.

40. The image forming system according to claim 36, wherein the control section registers the transfer sheet color regarding the color of the transfer sheet loaded on each sheet feed tray according to an input from an operation input section.

41. The image forming system according to claim 36, wherein the control section:

registers, as a tray information, a kind, a size, a weight, and a transfer sheet color of transfer sheets loaded on each sheet feed tray;

designates, as a job setting, a kind, a size, a weight, and a transfer sheet color of each sheet to be used for forming image thereon;

when forming image, selects the transfer sheets loaded on each sheet feed tray responding to the job based on the tray information and controlling the conveying section to convey the sheets; and displays, on the display apparatus, the kind, the size, the weight, and the transfer sheet color designated by the job, the transfer sheet color detected by the color detection section, and the kind, the size, and the weight registered to the tray of the transfer sheets conveyed by executing the job.

* * * * *